United States Patent [19]

Price, III

[11] Patent Number: 5,014,171

[45] Date of Patent: May 7, 1991

[54] COLOR CHANGEABLE FLASHLIGHT

[76] Inventor: George T. Price, III, 2223 E. 37th St., Los Angeles, Calif. 90058

[21] Appl. No.: 432,986

[22] Filed: Nov. 7, 1989

[51] Int. Cl.[5] ..... F21V 9/00

[52] U.S. Cl. ..... 362/277; 362/186; 362/293; 362/319

[58] Field of Search ..... 362/186, 208, 256, 277, 362/293, 319, 806; 350/311, 318

[56] References Cited

U.S. PATENT DOCUMENTS

| | | | |
|---|---|---|---|
| 2,420,307 | 5/1947 | Fristoe | 362/186 X |
| 4,307,439 | 12/1981 | Sassmannshausen | 362/277 X |
| 4,530,039 | 7/1985 | Shin-Shi | 362/186 X |

*Primary Examiner*—Stephen F. Husar

*Attorney, Agent, or Firm*—Freilich, Hornbaker & Rosen

[57] ABSTRACT

A flashlight is provided that can be switched between a white light mode wherein it produces white light and a color mode wherein it produces primarily light of a particular color such as red, which can be easily operated with the same hand that holds the flashlight. A hood (34 of FIG. 2) of material that passes only red light is mounted on the lens (40) of the flashlight, and the periphery of the lens is mounted on a select member (46) that can be moved forwardly and rearwardly with respect to the rest of the flashlight. When the select member is moved to its rearward position, the hood intercepts substantially all of the light passing between a lamp (32) and the reflector (36) of the flashlight, so that primarily red light is produced by the flashlight. When the select member is moved to a forward position (46A), the hood lies forward of most of the light rays passing between the lamp and the reflector, so the flashlight produces primarily white light. A person holding a flashlight in the usual manner, can use fingers of the same hand holding the flashlight to move the select member.

6 Claims, 1 Drawing Sheet

COLOR CHANGEABLE FLASHLIGHT

BACKGROUND OF THE INVENTION

Flashlights that produce red light are often used by pilots, military personnel, and other persons who must examine maps, instrument panels in case of a power failure in the cockpit, and the like without decreasing their night vision capacity. In fact, the U.S. Government (FAA) requires that a red flashlight be available to commercial pilots. However, it is desirable that these flashlights be capable of emitting white light when this is required. A common arrangement is to provide a color filter that can be snapped over the lens to produce red light or removed for white light. However, the snapped-on lenses become lost. It should be noted that some persons prefer a different color than red, such as green light.

Applicant has been manufacturing and selling a full size flashlight (that takes two D-size batteries, or cells) with a built-in mechanism that can switch between red light and white light modes. The flashlight includes a tube of material that transmits primarily red light and that is slideably mounted on the flashlight lens between rearward and forward positions wherein the tube respectively surrounds and does not surround the lamp of the flashlight. In the rearward position, the tube intercepts substantially all light passing between the lamp and the reflector so the flashlight produces red light. In a forward position, almost all light from the lamp can reach the reflector without passing through the tube, so the flashlight produces white light. Although this flashlight has been successful, there are some disadvantages in its operation. One disadvantage is that a person must grasp a small fastener knob lying at the middle of the lens to pull the tube forwardly. This requires a person holding the flashlight in one hand to use his other hand to pull the fastener. Thus, operation requires the use of two hands, with the hand pulling the fastener not being enclosed in a glove.

Applicant has attempted to design a miniature flashlight (taking two AA-size cells) similar to the above-described type that has a slideable hood. However, the difficulty in grasping the fastener become much more pronounced for a small size flashlight because the knob would lie in a small diameter (e.g. less than one inch) recess in which the lens lies. A flashlight that could be switched between color and white light modes, which could be easily operated by fingers of the same hand that normally grasps the flashlight, and in a simple manner, would be of considerable value.

SUMMARY OF THE INVENTION

In accordance with one embodiment of the present invention, a flashlight is provided that can be easily switched between color and white light modes. The flashlight includes a main flashlight section having a frame, a lamp in a front portion of the frame, and a reflector lying about the lamp. The flashlight also includes a hood that has a tube which passes primarily light of a selected color. A select member is coupled to the hood and is supported on the flashlight frame in movement between first and second positions. In the first position, the tube intercepts most of the light passing along paths from the lamp to the reflector, to allow primarily light of a selected color to pass. In the second position of the select member, it holds the tube in a position at which it does not intercept most of the light passing between the lamp and the reflector, thus allowing the flashlight to be operated in a normal flashlight manner.

The hood can be mounted directly on the middle of the lens of the flashlight, and the periphery of the lens can be mounted on the select member, with the select member surrounding the front of the flashlight frame. An O-ring mounted in a groove on the frame can engage the internal surface of the select member, and the internal surface of the select member can be formed with two grooves that retains the select member in its first or second positions when moved thereto.

The novel features of the invention are set forth with particularity in the appended claims. The invention will be best understood from the following description when read in conjunction with accompanying drawings.

DESCRIPTION OF THE PREFERRED EMBODIMENT

Figure 1:
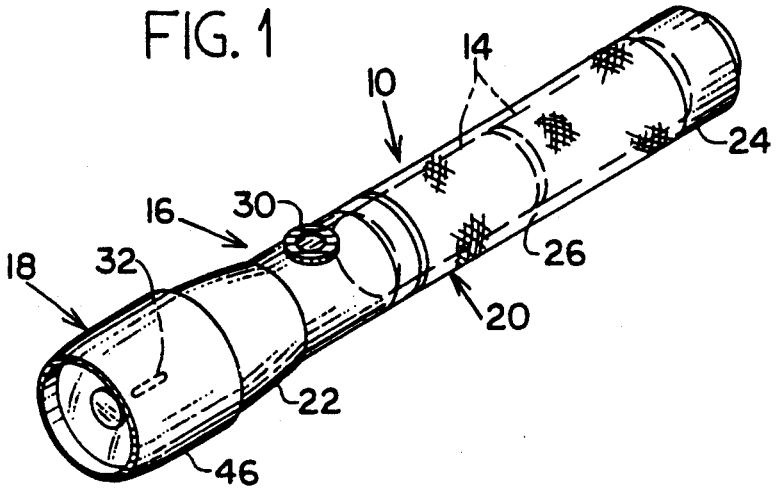
FIG. 1 is a perspective view of a flashlight constructed in accordance with the present invention.

FIG. 1 illustrates a flashlight 10 of a miniature type which holds a pair of AA batteries or cells 14. The flashlight includes a main section 16 which is constructed substantially as an ordinary flashlight of this type, and a color filter assembly 18 that changes the color of the light produced by the flashlight. The main section includes a frame 20 with front and rear portions 22, 24, the frame having a battery compartment 26. A switch 30 can be operated to connect the batteries to a lamp 32.

Figure 2:
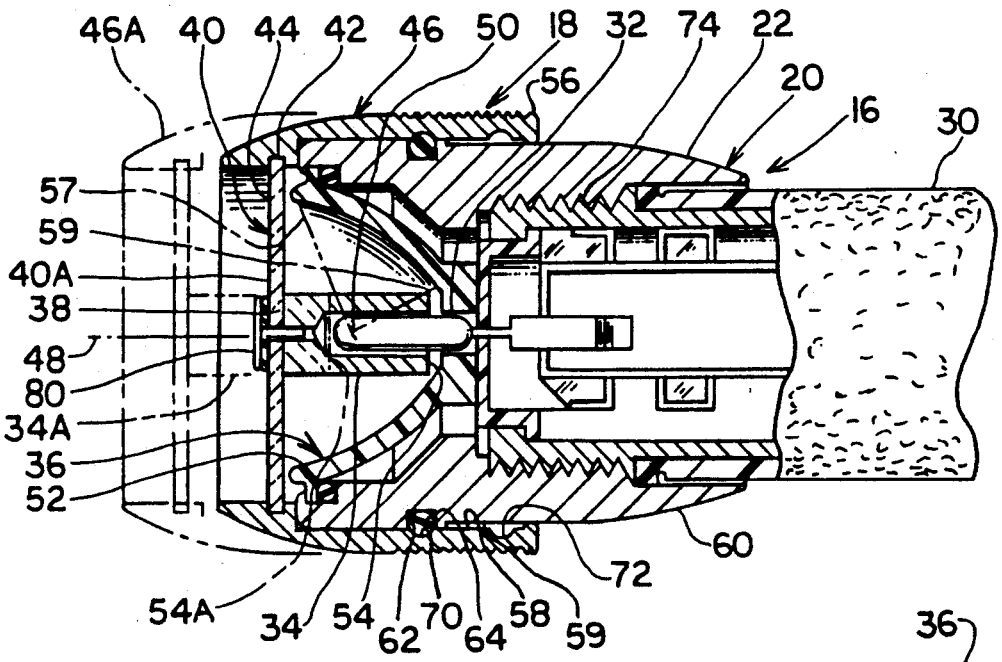
FIG. 2 is a sectional view of the forward portion of flashlight of FIG. 1.
Figure 3:
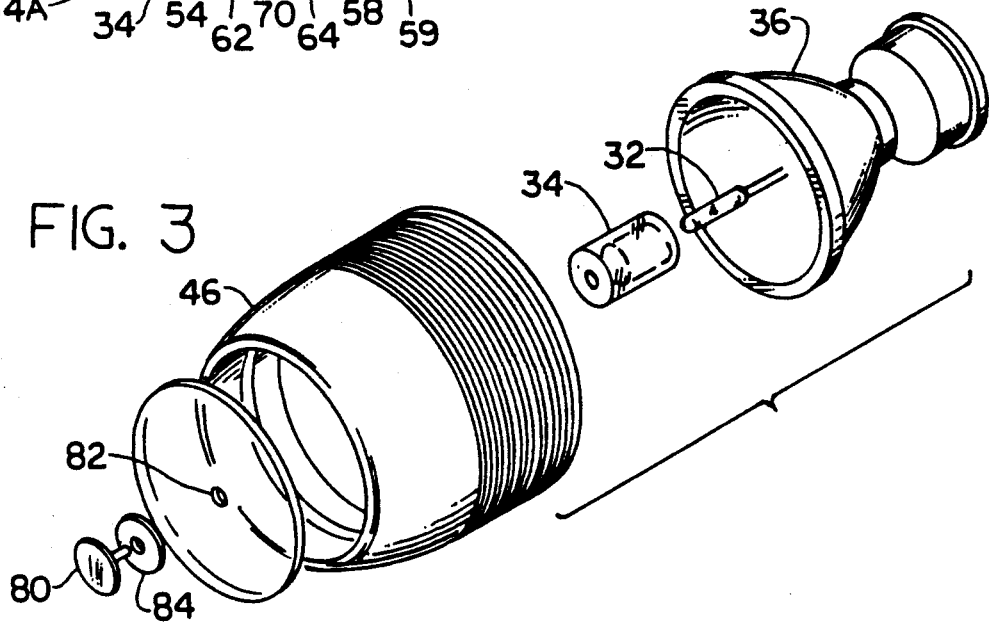
FIG. 3 is an exploded isometric view of parts of the forward portion of the flashlight of FIG. 2.

As shown in FIG. 2, the color filter assembly 18 includes a hood 34 that is largely in the form of a tube, which is constructed of light passing filter material that passes primarily light of a particular color such as red. Thus, light can pass from the lamp 32 against a reflector 36 to shine in a generally forward direction out of the flashlight. The hood 34 is mounted on the middle portion 38 of a lens 40 which is a flat sheet of transparent plastic used to keep out dust and water. The peripheral lens portion 42 is held in a groove 44 of a lens ring or select member 46 that is slideably mounted on the front portion 22 of the frame. Thus, the lens serves as a coupling.

The select member 46 can be moved along the reflector axis 48 in forward and rearward directions indicated by arrows F and R. In the rearward position the hood 34 lies about the lamp 32, and specifically about a small light emitting part 50 of the lamp where the lamp filament is located. It may be noted that the particular lamp shown is a small high intensity lamp whose filament at 50 is small, to facilitate control of the flashlight light beam. In the rearward position of the hood, the hood intercepts most of the light passing between the lamp emitting part 50 and the reflective surface 52 of the reflector. In fact in the rearward position, the hood intercepts substantially all (over 95%) of such light that will pass forwardly out of the lens. A person viewing the flashlight does not see a white light annular band of appreciable width within a wide red light annular band. As a result, the light beam from the flashlight is red. The select member 46 can be moved forwardly to a forward position indicated at 46A to thereby move the lens to a position 40A and the hood to the position 34A, with the rear end 54 of the tube moved to the position 54A. With the rear end of the tube at 54A, it does not intercept most of the light passing from the lamp to the reflector, and, in fact, intercepts substantially none of the light. As a result, the white light output of the lamp passes to the reflector and through the non-color transparent lens 40 to produce a white light beam.

FIG. 2 shows two light rays 57 and 59 from the lamp that are near extremes of angles that reach the reflector. When the hood is in the color mode at 24, both rays 57, 59 are intercepted by the hood. In the white light mode of the hood at 34A, neither ray is intercepted by the hood.

The select member 46 has a rearward portion 56 with a substantially cylindrical internal surface 58 that surrounds a substantially cylindrical outer surface 59 formed by a front part 60 of the flashlight frame. The frame front part 60 has a groove 62 that holds an elastomeric ring 64 which bears against the inside surface 58 of the select member, to form a watertight seal therewith.

It would be possible to rely solely upon friction of the select member with the front frame part, and especially with the O-ring 64, to hold the select member in its forward or rearward positions (or any position in between to produce a selected mixture of white and red light), with a stop to limit excess forward movement of the select member. However, applicant finds that when the select member is moved forwardly or rearwardly, it creates a vacuum or pressured air (above atmospheric) in the region between the lens and the reflector. It may take a second or two for the pressure or vacuum to dissipate, and unless the select member is held for a second it tends to creep away from the position to which it was moved. To prevent such unwanted movement, applicant includes first and second annular grooves 70, 72 that receive the protruding portion of the O-ring 64 respectively in the rearward and forward positions of the select member.

The frame 20 of the main flashlight section 16 includes the rear portion 24 which holds the batteries, switch, and lamp 32, and which has a threaded front end 74 that is threadably connected to a separate front frame portion 22 that holds the reflector 36. The front frame portion 22 can be turned to advance the reflector forwardly or rearwardly so as to change the focus of the beam produced by the flashlight. This construction is shown in greater detail in my earlier U.S. Pat. No. 4,843,526. The positioning of the select member 46 around a forward part of the frame forward portion 22 does not prevent turning of the frame portion 22 to change the focus of the flashlight.

The flashlight can be comfortably held in one hand, by a person holding the rearward portion of the flashlight in his palm, so he can move his thumb over the switch 30 to operate it. The person can switch between the white light mode and the color mode by placing his thumb and forefinger on the select member 46 and pushing it forwardly or rearwardly. All of the surfaces to be grasped are large external surfaces, and the person can operate the color filter assembly while there is a glove on his hand that holds the flashlight.

The red transparent hood 34 is held to the lens by a fastener 80 that projects through a small hole 82 in the lens and in a watertight gasket 84 and attaches (as with adhesive) to the front end of the hood. While such mounting of the hood directly on the lens, and mounting the lens directly on the select member, provides a simple arrangement for coupling the hood to the select member, other arrangements can be used. For example, it is possible to use a spider (e.g. a device with three radially extending arms) to couple the hood to the select member, although there is generally no advantage to this. It would also be possible to move the hood (with the lamp-receiving hole or tube extending to its front end) rearwardly into a recess in the bottom of the reflector to switch to the white light mode, although there is also generally no advantage to this. It should be noted that applicant's description that the hood allows substantially only one color of light to pass, means that the observer sees a particular color of light for the emission of a particular lamp, and that the color may include light of a spectrum of different wavelengths. The hood can be constructed to pass light of colors such as green or infrared, instead of red.

Thus, the invention provides a flashlight of the type that can be changed between a white light mode and a color mode, which facilitates such changeover. A hood which allows primarily light of only one color to pass between the lamp and the reflector, is coupled to a select member that lies at the outside of the flashlight frame, which facilitates movement of the select member and which can allow such movement to be accomplished by the same hand that holds the flashlight, and even when that hand is wearing a glove. An elastomeric or O-ring which seals a largely cylindrical select member to the front portion of the flashlight frame, can have two grooves that selectively receive a protruding part of the O-ring in forward or rearward positions of the select member to keep the member in that position, despite a temporary vacuum or pressure around the lamp. While the invention is especially useful for miniature flashlights, it is also very useful for larger flashlights.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A flashlight comprising:

a main section which includes a frame with front and rear portions forming a battery compartment, a lamp at said frame front portion, a reflector lying about said lamp, and a switch whch connects batteries in said compartment to said lamp, said lamp having a light emitting part;

a hood of light passing filter material which passes primarily light of a selected color;

a select member moveably mounted on said main section and coupled to said hood to support said hood in movement between a color mode wherein said hood lies about said lamp so most of the light passing in paths between said lamp and reflector passes through said material of said hood, and a white light mode wherein most of said filter material of said hood lies away from said paths so most of the light passing between said lamp and reflector does not pass through said filter material of said hood; and a lens lying forward of said lamp;

said hood being mounted on said lens, and said select member supporting said lens in movement between a rearward lens position wherein said hood is in said color mode and a forward lens position wherein said lens is forward of said rearward lens position and supports said hood in said white light mode.

2. The flashlight described in claim 1 wherein:

said lens has a peripheral portion, said select member which supports said lens has a forward portion that engages said peripheral portion of said lens to support it, and said select member has a rearward portion that is slideable in forward and rearward directions on said frame front portion.

3. The flashlight described in claim 2 wherein:

said select member rear portion surrounds said frame front portion, said frame front portion has an annular groove and an elastomeric ring lying primarily in said groove and projecting outwardly therefrom, and said select member rear portion has an internal surface that has forward and rearward internal annular grooves that receive said projecting elastomeric ring portion respectively in forward and rearward member positions wherein said lens is held in said lens forward and rearward positions, whereby to retain said member and hood in one of said positions despite an at least temporary vacuum or pressure behind said lens.

4. In a flashlight that includes a frame with a battery compartment for holding at least one battery, a lamp, a switch in said frame connecting a battery in said compartment to said lamp, a reflector which surrounds said lamp and reflects light from said lamp in a predetermined generally forward direction, and a lens lying in front of said reflector, said frame having an outside extending around said reflector, the improvement comprising:

a hood which passes primarily light of a selected color;

a select member which is supported on said frame in movement between first and second positions, said hood being coupled to said select member to be moved by said select member between a color mode position at which said hood intercepts most of the light passing along paths from said lamp to said reflector, and a white light position at which said hood does not intercept most of the light passing along said paths;

said select member lies substantially on the outside of said frame so said member can be readily moved between said first and second positions by fingers of the same hand that is holding said frame.

5. The improvement described in claim 4 wherein:

said hood is mounted on said lens, and said lens has a peripheral portion supported by said select member in rearward and forward movement on said frame to move said hood respectively between said color and white light positions.

6. The improvement described in claim 5 wherein:

said lens and the region where said lens peripheral portion is supported by said select member, are all substantially waterproof, and said select member surrounds and slides on said frame; and including:

an O-ring disposed between said frame and select member with one of them having a deep O-ring groove for retaining said O-ring and allowing it to project slightly therefrom, and the other having first and second annular grooves that receive said O-ring respectively in forward and rearward positions of said select member.

* * * * *